US008582998B2

(12) United States Patent
Hayase et al.

(10) Patent No.: US 8,582,998 B2
(45) Date of Patent: Nov. 12, 2013

(54) FIXING DEVICE AND IMAGE FORMING APPARATUS

(75) Inventors: Toru Hayase, Toyohashi (JP); Naoki Yamamoto, Toyohashi (JP); Noboru Yonekawa, Toyohashi (JP); Mamoru Fukaya, Nagoya (JP)

(73) Assignee: Konica Minolta Business Technologies, Inc, Chiyoda-Ku, Tokyo (JP)

( * ) Notice: Subject to any disclaimer, the term of this patent is extended or adjusted under 35 U.S.C. 154(b) by 234 days.

(21) Appl. No.: 13/034,224

(22) Filed: Feb. 24, 2011

(65) Prior Publication Data

US 2011/0222932 A1 Sep. 15, 2011

(30) Foreign Application Priority Data

Mar. 15, 2010 (JP) ..... 2010-057108

(51) Int. Cl.
*G03G 15/00* (2006.01)
*G03G 15/20* (2006.01)

(52) U.S. Cl.
USPC ..... 399/90; 399/329

(58) Field of Classification Search
USPC ..... 399/90, 329
See application file for complete search history.

(56) References Cited

U.S. PATENT DOCUMENTS

| | | | | |
|---|---|---|---|---|
| 4,776,070 | A | 10/1988 | Shibata et al. | |
| 6,574,449 | B2 * | 6/2003 | Yoda et al. | 399/329 |
| 8,165,485 | B2 * | 4/2012 | Asakura et al. | 399/69 |
| 8,346,148 | B2 * | 1/2013 | Yonekawa et al. | 399/329 |
| 2001/0054609 | A1 | 12/2001 | Natsuhara et al. | |
| 2009/0169231 | A1 | 7/2009 | Asakura et al. | |

FOREIGN PATENT DOCUMENTS

| | | | |
|---|---|---|---|
| CN | 101470392 | | 7/2009 |
| JP | 63-11980 | | 1/1988 |
| JP | 08262906 | A * | 10/1996 |
| JP | 10-199658 | | 7/1998 |
| JP | 2002-31976 | | 1/2002 |
| JP | 2007-272223 | A | 10/2007 |
| JP | 2009-092785 | A | 4/2009 |
| JP | 2009-109997 | A | 5/2009 |

OTHER PUBLICATIONS

Machine Translation of JP 08-262906 A, obtained on Mar. 19, 2013.*

(Continued)

*Primary Examiner* — David Gray
*Assistant Examiner* — Gregory H Curran
(74) *Attorney, Agent, or Firm* — Buchanan Ingersoll & Rooney PC

(57) ABSTRACT

A fixing device includes: a heating rotary member having a heating layer generating heat upon current application; a pressurizing rotary member brought into pressure-contact with an outer circumferential surface of the heating rotary member to form fixing nip, through which a sheet on which unfixed toner image is formed passes for heat fixing; circular electrodes that are circumferentially formed at two respective positions sandwiching a sheet passing region therebetween, on the outer circumferential surface, and feed electrical power to the heating layer, the electrodes are each metallic and formed of at least two electrode layers including a first electrode layer layered directly on the heating layer and a second electrode layer as an outermost layer, linear expansion coefficient difference between the first layer and the heating layer is smaller than that between the second layer and the heating layer, and the second layer is more oxidation-resistant than the first layer.

14 Claims, 8 Drawing Sheets

(56) References Cited

OTHER PUBLICATIONS

Chinese Office Action issued on May 6, 2013 by the Chinese Patent Office in corresponding Chinese Patent Application No. 201110064913, with English translation thereof.

Japanese Office Action issued on Jul. 16, 2013 by the Japan Patent Office in corresponding Japanese Patent Application No. 2010-057108, with English translation thereof.

* cited by examiner

FIG. 6

| Metal | Electrical resistivity [$10^{-8}\Omega \cdot m$] | Linear expansion coefficient [$10^{-5}/°C$] | Mohs hardness | Oxidation resistance | Suitability for electrode interlayer | Suitability for electrode surface layer |
|---|---|---|---|---|---|---|
| Silver | 1.59 | 1.9 | 2.5 | B | Favorable | Unfavorable |
| Copper | 1.68 | 1.7 | 3 | B | Favorable | Unfavorable |
| Gold | 2.21 | 1.4 | 2.5 | A | Unfavorable | Unfavorable |
| Aluminum | 2.65 | 2.44 | 2.5 | C | Favorable | Unfavorable |
| Magnesium | 4.42 | 2.13 | 2.5 | C | Unfavorable | Unfavorable |
| Tungsten | 5.29 | 0.45 | 7.5 | A | Unfavorable | Favorable |
| Cobalt | 5.81 | 1.25 | 5 | A | Unfavorable | Unfavorable |
| Zinc | 6.02 | 3.5 | 2.5 | C | Favorable | Unfavorable |
| Brass | 6.3 | 1.84 | 3-4 | B | Favorable | Unfavorable |
| Nickel | 6.99 | 1.3 | 4 | A | Unfavorable | Favorable |

Oxidation resistance : A (Good), B (Normal), and C (Bad)
PI linear expansion coefficient : 5.4[$10^{-5}/°C$]

| Electrode | Outermost layer | Linear expansion coefficient difference ($10^{-5}$) | Oxidation resistance | Detachment resistance | Electrical conductivity |
|---|---|---|---|---|---|
| Copper (single layer) | Cu | 3.7 | 0 | 7 | 2 |
| Nickel (single layer) | Ni | 4.1 | 8 | 3 | 3 |
| Copper-nickel (double layer) | Ni | 3.7 | 8 | 8 | 8 |

Linear expansion coefficient difference:
Difference in linear expansion coefficient between PI and metal contacting PI

FIXING DEVICE AND IMAGE FORMING APPARATUS

This application is based on an application No. 2010-57108 filed in Japan, the contents of which are hereby incorporated by reference.

BACKGROUND OF THE INVENTION (1) Field of the Invention

The present invention relates to an electrode, which is for feeding an electrical power to a resistance heating layer, for use in an image forming apparatus and particularly in a fixing device.

(2) Description of the Related Art

An image forming apparatus such as a copy machine includes a fixing device for causing an unfixed image formed on a recording sheet to pass through a nip member formed by a heating rotary member and a pressurizing rotary member to fix the unfixed image onto the recording sheet. In recent years, in view points of energy saving and heating speed-up, there has been proposed a fixing method of using, as a heating rotary member, an endless belt including a resistance heating layer. This resistance heating layer is composed of a mixture of conductive materials, such as carbon powders and metallic powders, and heat-resistant insulating base materials, such as polyimide (PI) and a silicone rubber. An electrical power is fed to the resistance heating layer so as to directly heat the fixing belt to fix a toner image. According to this fixing method, a high heat efficiency is exhibited owing to a low heat capacity and a short distance from a heat source to a recording sheet that is to be heated. This enables short warm-up at a low electrical power consumption.

The heating method generally requires an electrical power feed to the resistance heating layer. Accordingly, the fixing device includes a power feeding member for feeding an electrical power to the resistance heating layer from the outside of the fixing belt, and also includes an electrode for receiving the electrical power fed from the power feeding member and transmitting the received electrical power to the resistance heating layer.

The above electrode is, for example, formed of a resin layer obtained by dispersing a conductive filler, or formed of adhered metal foil, metal mesh, and so on. These examples are disclosed in Japanese Patent Application Publication Nos. 2007-272223, 2009-109997, and 2009-92785.

However, in the case of use of an electrode formed of a resin layer obtained by dispersing a conductive filler, a higher electrical resistivity is exhibited compared with the case of use of an electrode formed of metal. Although this electrode does not need to generate heat, application of an electric current uselessly causes the electrode to generate heat. This results in a low heat efficiency.

On the other hand, in the case of use of an electrode formed of a metal having a low electrical resistivity, the mere use of metal for the electrode causes easy detachment of the electrode from a resistance heating layer.

SUMMARY OF THE INVENTION

The present invention was made in view of the above problems, and aims to provide a fixing device including an electrode with a low electrical resistivity and a high durability in which there is a low probability that the electrical conductivity decreases due to detachment of the electrode from a resistance heating layer and oxidation of the electrode, and also aims to provide an image forming apparatus including the fixing device.

The above aim is achieved by a fixing device comprising: a heating rotary member that has a resistance heating layer that generates heat when an electrical current is applied; a pressurizing rotary member that is brought into pressure-contact with an outer circumferential surface of the heating rotary member so as to form a fixing nip, through which a recording sheet on which an unfixed toner image has been formed passes for heat fixing; a pair of circular electrodes that are each circumferentially formed at a respective one of two positions on the outer circumferential surface of the heating rotary member, and feed an electrical power to the resistance heating layer, the two positions sandwiching a sheet passing region therebetween, wherein the electrodes are each metallic and formed of at least two electrode layers including a first electrode layer that is layered directly on the resistance heating layer and a second electrode layer that is an outermost layer, difference in linear expansion coefficient between the first electrode layer and the resistance heating layer is smaller than difference in linear expansion coefficient between the second electrode layer and the resistance heating layer, and the second electrode layer is more oxidation-resistant than the first electrode layer.

The above aim is also achieved by an image forming apparatus comprising: an image forming part operable to form an unfixed toner image on a recording sheet; and a fixing device operable to thermally fix the unfixed toner image onto the recording sheet, the fixing device including: a heating rotary member that has a resistance heating layer that generates heat when an electrical current is applied; a pressurizing rotary member that is brought into pressure-contact with an outer circumferential surface of the heating rotary member so as to form a fixing nip, through which a recording sheet on which an unfixed toner image has been formed passes for heat fixing; a pair of circular electrodes that are each circumferentially formed at a respective one of two positions on the outer circumferential surface of the heating rotary member, and feed an electrical power to the resistance heating layer, the two positions sandwiching a sheet passing region therebetween, wherein the electrodes are each metallic and formed of at least two electrode layers including a first electrode layer that is layered directly on the resistance heating layer and a second electrode layer that is an outermost layer, difference in linear expansion coefficient between the first electrode layer and the resistance heating layer is smaller than difference in linear expansion coefficient between the second electrode layer and the resistance heating layer, and the second electrode layer is more oxidation-resistant than the first electrode layer.

BRIEF DESCRIPTION OF DRAWINGS

These and the other objects, advantages and features of the invention will become apparent from the following description thereof taken in conjunction with the accompanying drawings which illustrate a specific embodiment of the invention.

In the drawings:

FIG. 6 is a table showing electrical resistivity, linear expansion coefficient, Mohs hardness, oxidation resistance, suitability for electrode interlayer, and suitability for electrode surface layer, with respect to metal materials;

DESCRIPTION OF PREFERRED EMBODIMENTS

Embodiment 1

The following describes an embodiment of a fixing device and an image forming apparatus relating to the present invention, using an example of a tandem-type color digital printer (hereinafter, simply referred to as "printer").

(1-1. Overall Structure of Printer)

Figure 1:
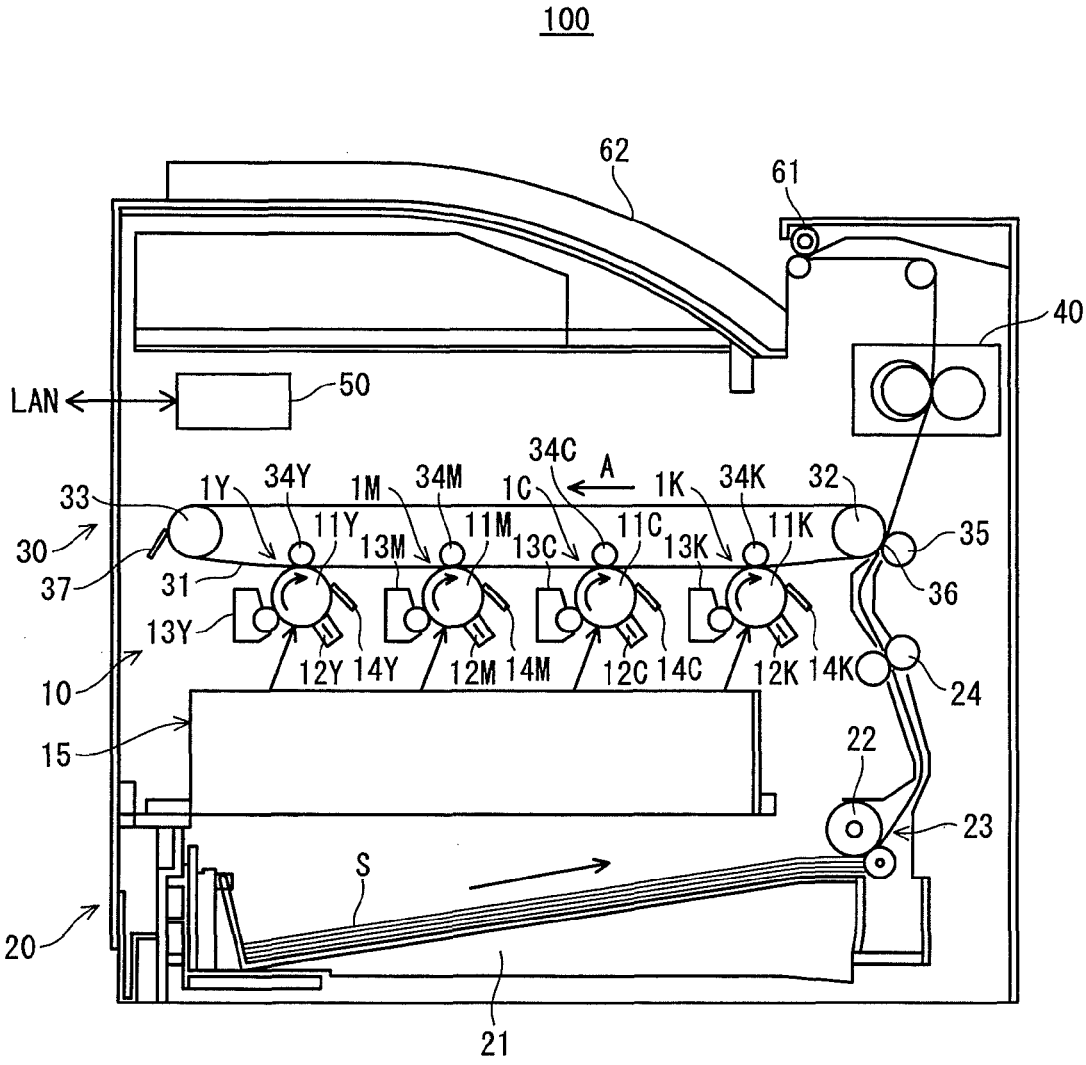
FIG. 1 shows an outline structure of an image forming apparatus relating to embodiments of the present invention.

FIG. 1 is an outline cross-sectional view showing an overall structure of a printer 100 relating to embodiments of the present invention. The printer 100 includes an image forming unit 10, a paper feed unit 20, a transfer unit 30, a fixing device 40, a control unit 50, and so on.

The printer 100 is connected to a network such as a LAN (Local Area Network). Upon receiving an instruction to execute a print job from an external terminal apparatus (not shown), the printer 100 performs full-color image formation by forming toner images of cyan, magenta, yellow, and black colors, and multiple-transferring the formed toner images.

Hereinafter, the cyan, magenta, yellow, and black reproduction colors are represented as C, M, Y, and K, respectively, and the letters C, M, Y, and K are appended to reference numbers of components relating to the corresponding reproduction colors.

The image forming unit 10 includes image formers 1C, 1M, 1Y, and 1K, an optical unit 15, an intermediate transfer belt 31, cleaner blades 14 and 37, and so on.

The intermediate transfer belt 31 is an endless belt suspended in a tensioned state on a driving roller 32 and a driven roller 33, and is driven to rotate in a direction indicated by an arrow A.

The cleaner blades 14 and 37 are arranged so as to be in contact with a photosensitive drum 11 and the intermediate transfer belt 31 in the counter direction, respectively, and clean dust such as residual toner and paper powders on surfaces of the photosensitive drum 11 and the intermediate transfer belt 31, respectively.

The optical unit 15 includes light emitting devices such as laser diodes. Upon receiving a drive signal transmitted from the control unit 50, the optical unit 15 emits laser beams L to perform exposure scanning of the photosensitive drums 11C, 11M, 11Y, and 11K for forming images in colors C, M, Y, and K, respectively. As a result of this exposure scanning, electrostatic latent images are formed on the photosensitive drums 11C, 11M, 11Y, and 11K that have been charged by electric chargers 12C, 12M, 12Y, and 12K, respectively. The electrostatic latent images are developed by the developers 13C, 13M, 13Y, and 13K. The toner images of colors C, M, Y, and K, which have been formed on the photosensitive drums 11C, 11M, 11Y, and 11K, respectively, are primary-transferred on the intermediate transfer belt 31 at different timings, such that each of the toner images of colors C, M, Y, and K are layered on the intermediate transfer belt 31 in the same position. The toner images of colors C, M, Y, and K are sequentially transferred onto the intermediate transfer belt 31 by electrostatic power acting on primary transfer rollers 34C, 34M, 34Y, and 34K, respectively. As a result, a full-color toner image is formed. The full-color toner image is then carried to a secondary transfer position 36.

On the other hand, the paper feed unit 20 includes a paper feed cassette 21 for housing therein pieces of sheets S, a pickup roller 22 for picking up the sheets S housed in the paper feed cassette 21 and directing the sheets S onto a conveyance path 23 piece by piece, a pair of timing rollers 24 for adjusting a timing of sending the sheet S onto the secondary transfer position 36, and so on. The sheet S is conveyed from the paper feed unit 20 to the secondary transfer position 36, in accordance with a timing at which the toner images are conveyed on the intermediate transfer belt 31. The toner images on the intermediate transfer belt 31 are secondarily-transferred collectively onto the sheet S by electrostatic power acting on the secondary transfer roller 35.

After passing through the secondary transfer position 36, the sheet S is continuously conveyed to the fixing device 40. Once the toner images formed on the sheet S (that have not yet been fixed) are fixed onto the sheet S by thermocompression performed by the fixing device 40, the sheet S is discharged to a discharge tray 62 via a pair of discharge rollers 61.

Also, the control unit 50 performs communication with an external terminal, image processing, control to drive the above components, and so on.

On an upper and front portion of the printer 100 where a user conveniently operates, an operation panel is provided (not shown). The operation panel includes a numeric keypad for inputting the number of copy sheets, a copy start key for instructing to start copy, and a key for selecting an image forming mode. The operation panel further includes a touch-screen liquid crystal display unit for displaying a message screen displaying the status of the printer 100. For example, the message screen displays the status where the printer 100 is waiting for a job execution instruction (the printer 100 is in the idle state). The printer 100 receives selection of paper feed tray and adjustment of copy concentration, and so on via a touch screen function of the liquid crystal display unit.

(1-2. Structure of Fixing Device 40)

Figure 2:
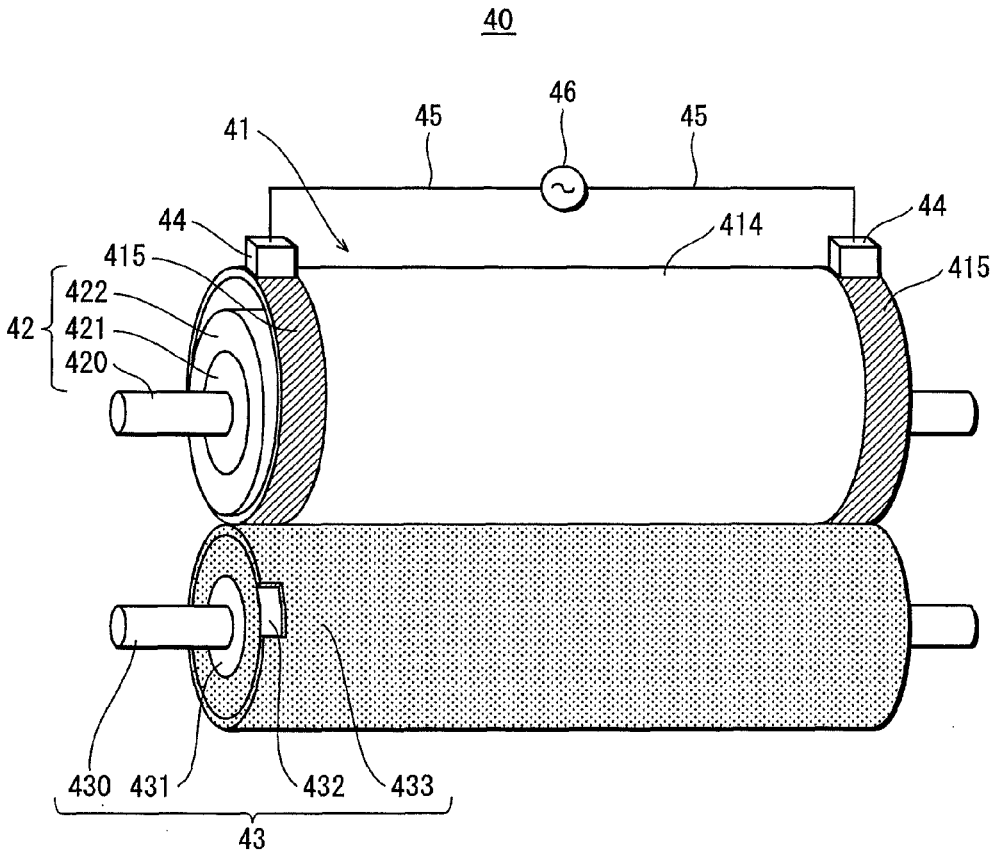
FIG. 2 is a schematic pattern view, partially broken away, showing a principal structure of a fixing device relating to an Embodiment 1 of the present invention.
Figure 3:
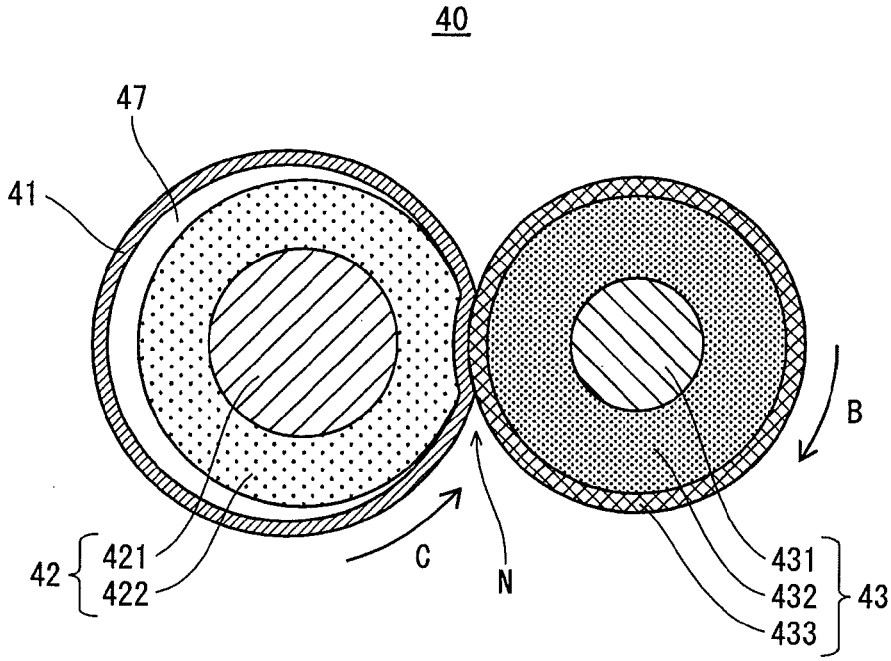
FIG. 3 is a cross-sectional pattern view showing the principal structure of the fixing device relating to the Embodiment 1 of the present invention.

FIG. 2 is a schematic view, partially broken away, showing a principal structure of the fixing device 40. FIG. 3 is a cross-sectional view showing the principal structure of the fixing device 40. As shown in FIG. 2 and FIG. 3, the fixing device 40 includes a heat fixing belt 41 that is an elastically deformable endless belt as a heating rotary member, a fixing roller 42 as a pressing member, a pressurizing roller 43 as a pressurizing rotary member, power feeding members 44 for feeding an electrical power to the heat fixing belt 41 for heat generation.

The heat fixing belt 41 is cylindrical, and has a shape-retaining property. Specifically, the heat fixing belt 41 elastically deforms in response to application of a certain amount of pressing force in a radius direction thereof. When the application of the pressing force stops in such a deformed state, the heat fixing belt 41 restores to its original shape owing to its resilience. The heat fixing belt 41 has an inner diameter of 30 [mm] for example.

The fixing roller 42 is formed by layering an elastic layers 422 on a circumference of an elongated metal core 421, and is arranged inside a rotation path of the heat fixing belt 41. This rotation path is a path on which the heat fixing belt 41 runs, and hereinafter is referred to as "belt rotation path". The metal core 421 functioning as a shaft is formed of aluminum, stainless, or the like having a diameter of 18 [mm], for example. The elastic layer 422 is formed of a heat-resistant rubber such as a silicone rubber and a fluorine rubber, or a foam material of such a heat-resistant rubber (in some cases, formed of a laminate of such heat-resistant rubber and/or foam materials of this type), and has a thickness of 5 [mm] for example.

The fixing roller 42 has an outer diameter smaller than an inner diameter of the heat fixing belt 41, and has an outer diameter of 28 [mm], for example. The heat fixing belt 41 and the fixing roller 42 are in contact with each other at a fixing nip N, and are separated from each other with a space 47 therebetween at a part other than the fixing nip N.

According to such a structure in which there is a space between the heat fixing belt 41 and the fixing roller 42, it is possible to exhibit the following effects, compared with a structure in which heat fixing belt 41 and the fixing roller 42 are in close contact with each other (structure in which there is no space). A contact area of the heat fixing belt 41 and the heat fixing belt 41, where heat generated from the heat fixing belt 41 is transferred to the fixing roller 42, is small. This reduces the heat loss that heat generated from the heat fixing belt 41 is partially transferred, through the metal core 421, to the housing 48 (see FIG. 4) which rotatably supports the shaft 420 on each end of the metal core 421. As a result, it is possible to realize a high heat efficiency.

The pressurizing roller 43 is formed by layering, on a circumference of an elongated metal core 431, an elastic layer 432 and, a releasing layer 433 in this order. The pressurizing roller 43 is arranged outside the belt rotation path of the heat fixing belt 41. In response to application of force by a forcing mechanism (not shown), the pressurizing roller 43 presses the fixing roller 42 via the heat fixing belt 41, such that the fixing nip N is formed between the surface of the pressurizing roller 43 and the surface of the heat fixing belt 41. The pressurizing roller 43 has an arbitrary outer diameter, and has an outer diameter of 35 [mm] for example.

The metal core 431 is formed of aluminum, iron, or the like, and has an outer diameter of 30 [mm] for example. The metal core 431 is hollow and pipe-shaped and has a thickness of 2 [mm], for example. Alternatively, the metal core 431 may be solid and cylindrical, or may have a cross section whose shape is a wheel with spokes, such as a three-pointed star in a circle.

The elastic layer 432 is formed of a heat-resistant rubber such as a silicone rubber and a fluorine rubber, a foam material of such a heat-resistant rubber, or the like, and has a thickness of 2.5 [mm] for example.

The releasing layer 433 is formed of a tube or coating of fluorine resin such as a PFA or the like, and has a thickness of 20 [μm] for example. The releasing layer 433 may have a conductive property for preventing toner offset caused by charging.

The fixing roller 42 has the structure in which the shaft 420 on each end of the metal core 421 in the shaft direction is rotatably supported by the housing 48 (see FIG. 4) of the fixing device 40 via a bearing member (not shown). The pressurizing roller 43 has the similar structure in which a shaft 430 on each end of the metal core 431 in the shaft direction is rotatably supported by the housing 48 of the fixing device 40 via a bearing member (not shown).

In response to a driving force applied by a drive motor (not shown), the pressurizing roller 43 is driven to rotate in a direction indicated by an arrow B. In accordance with the rotation of the pressurizing roller 43, the heat fixing belt 41 circularly runs in a direction indicated by an arrow C, and the fixing roller 42 is driven to rotate in the same direction indicated by the arrow C. Note that the fixing roller 42 may be driven to rotate, and in accordance with the rotation of the fixing roller 42, the heat fixing belt 41 may circularly run in the direction indicated by the arrow C, and the pressurizing roller 43 may be driven to rotate in the same direction indicated by the arrow C.

On the entire outer circumferential surface of each end ("two positions") of the heat fixing belt 41 sandwiching a sheet passing region in the shaft direction of the fixing roller 42, an electrode 415 is provided. Hereinafter, the shaft direction of the fixing roller 42 is referred to as "roller shaft direction". In response to application of a force from the outside to the inside of the heat fixing belt 41, the power feeding members 44 are brought into pressure-contact with the electrodes 415. The details are described later.

The feeding members 44 are each a rectangular parallelepiped block having dimensions of 10 [mm] long, 5 [mm] wide, and 7 [mm] high, and is a so-called carbon brush formed of a slidable and conductive material such as a copper-graphite material and a carbon-graphite material. The feeding members 44 are each electrically connected to a power source 46 via a conductive line (harness) 45.

Figure 4:
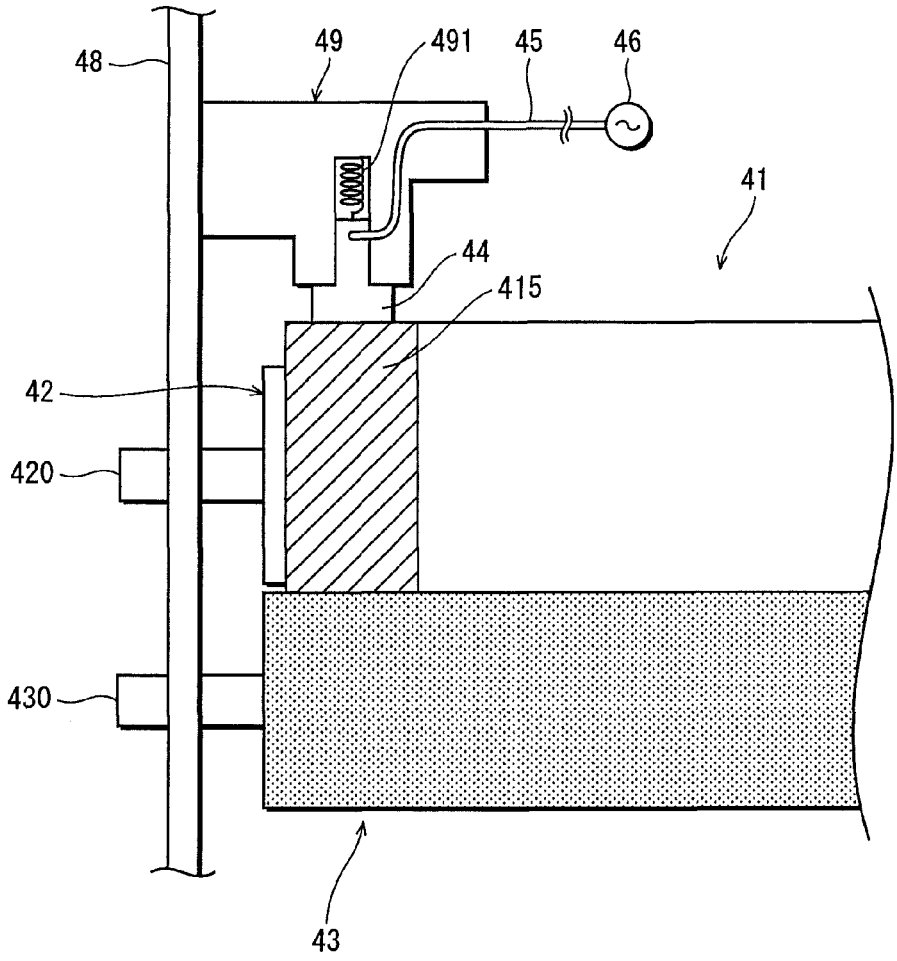
FIG. 4 is a plan view showing an outline structure of the fixing device shown in FIG. 2, focusing on a part where a feeding member is in pressure-contact with an electrode.

FIG. 4 shows an outline structure of one end of the heat fixing belt 41 in the roller shaft direction and its surroundings. The housing 48 has fixed thereto a guide member 49 for holding the power feeding member 44. In the case where the rotation path of the heat fixing belt 41 has a substantially circular cross section perpendicular to the roller shaft direction, the power feeding member 44 is held by the guide member 49 so as to be slidable in a radial direction of the circular cross section. The power feeding member 44 is forced by the elastic member 491, which is formed of a spring or the like, toward a direction for forcing the electrode 415 toward the fixing roller 42. This force brings the power feeding member 44 into pressure-contact with the electrode 415. The power feeding member 44 is subjected to a stress by rigidity of the heat fixing belt 41 in a direction opposite to the direction for forcing the electrode 415. This can keep the power feeding member 44 in contact with the electrode 415. Note that it may be possible to provide a backing member or the like in an inner circumferential surface of the heat fixing belt 41 so as to be subjected to a pressing force applied to the electrode 415 by the power feeding member 44. In this case, the backing member may be formed by coating a fluorine resin such as PFA for reducing the friction on a surface of a heat-resistant resin such as polyimide (PI), polyphenylene-sulfide (PPS), and polyetheretherketone (PEEK), and the coating is made on a surface, of such a heat-resistant resin, that is at least in sliding contact with the inner circumferential surface of the heat fixing belt 41. Alternatively, instead of additionally providing a backing member, the fixing roller 42 may be used as a backing member.

In FIG. 4, in order to show the fixing roller 42 arranged inside the rotation path of the heat fixing belt 41, the length of the heat fixing belt 41 in the roller shaft direction is slightly shorter than the length of the fixing roller 42 in the shaft direction such that the fixing roller 42 slightly protrudes from the heat fixing belt 41. However, the structure of the heat fixing belt 41 and the fixing roller 42 is not necessarily limited to this.

(1-3. Structure of Heat Fixing Belt 41)

Figure 5:
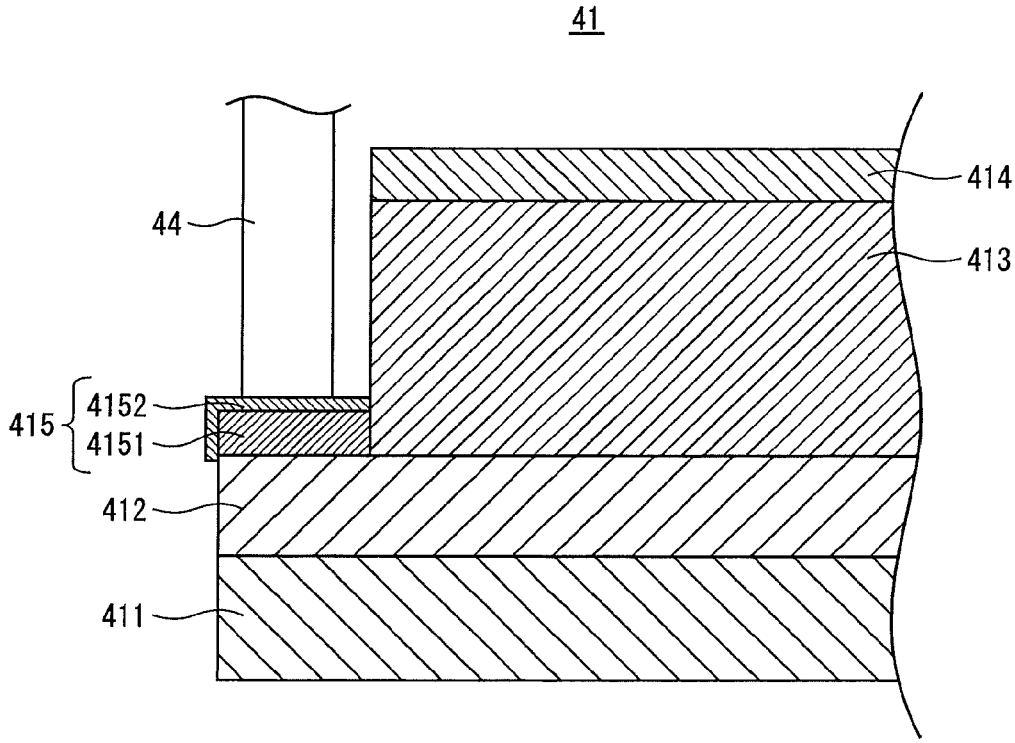
FIG. 5 is a partially enlarged cross-sectional pattern view showing an outline structure of a heat fixing belt and the electrode that are included in the fixing device relating to the Embodiment 1 of the present invention.

FIG. 5 is a partially enlarged cross-sectional view showing one end of the heat fixing belt 41 in the roller shaft direction, taken along a planar surface including the roller shaft. As shown in FIG. 5, the heat fixing belt 41 is formed by layering an insulation layer 411, a resistance heating layer 412, an elastic layer 413, and a releasing layer 414 in this order from the inside. Although FIG. 5 shows only one end of the heat fixing belt 41, the heat fixing belt 41 has a part on each end in the roller shaft direction where the elastic layer 413 and the releasing layer 414 are not formed. In this part, an electrode 415 is provided on the resistance heating layer 412.

The resistance heating layer 412 is obtained by dispersing a conductive filler in a heat-resistant resin such as PI, PPS, and PEEK. The conductive filler is a metal such as Ag, Cu, Al, Mg, and Ni, or a carbon-based filler such as a carbon nanotube, a carbon nanofiber, and a carbon microcoil. The conductive filler may be combination of two or more types among these metals and carbon-based fillers. By adjusting the type or amount of a conductive filler to be dispersed in a heat-resistant resin, it is possible to obtain a predetermined electrical resistivity.

It is desirable to use, as the conductive filler, a fibrous filler such as a carbon nanofiber. This is because the fibrous filler exhibits a high contact probability between fillers with a small dispersion amount, thereby to achieve a desired electrical resistivity. Also in the case where a metal filler is used as the conductive filler, a metal having an acicular crystal structure is preferable.

The resistance heating layer 412 has an arbitrary thickness, and has a thickness of approximately 5-100 μm for example.

The electrical resistivity of the resistance heating layer 412 is arbitrarily determined, based on the voltage applied by the power source 46, the thickness of the resistance heating layer 412, the length (width) of the heat fixing belt 41 in the roller shaft direction, and so on. The electrical resistivity of the resistance heating layer 412 is for example approximately $1.0\times10^{-6}$-$9.9\times10^{-3}$ [Ω·m], and is preferably $1.0\times10^{-5}$-$5.0\times10^{-3}$ [mm].

The insulation layer 411 is formed of a heat-resistant resin such as PI, PPS, and PEEK, which is the same type of resin used for the resistance heating layer 412, and preferably has a thickness of approximately 5-100 [mm] for example.

The elastic layer 413 is formed of a heat-resistant material such as a silicone rubber and a fluorine rubber, and has a thickness of approximately 100-300 [mm] for example.

The releasing layer 414 is formed by coating, on a surface of the elastic layer 413, a fluorine resin having a high releasing property such as PFA, PTFE (polytetrafluoroethylene), and ETFE (ethylene-tetra fluoroethylene). Alternatively, the releasing layer 414 may be formed of a tube of such a resin listed above. The releasing layer 414 has an arbitrarily thickness, and has a thickness of approximately 5-100 [mm] for example. The releasing layer 414 has a water contact angle of 90 degree or greater, and preferably has a water contact angle of 110 degree or greater. Also, the releasing layer 414 preferably has a surface roughness of approximately Ra: 0.01-50 [mm] for example. The fluorine tube for the releasing layer 414 may be products PFA350-J, 451-HP-J, and 951HP Plus manufactured by Du Pont-Mitsui Fluorochemicals Company, Ltd, for example.

(1-4. Structure of Electrode 415)

Assume a case where an electrode formed of metal having a low electrical resistivity is used. If there is a great difference in linear expansion coefficient between the metal and a resin such as PI that is the base material (binder resin) of the resistance heating layer, the resistance heating layer generates heat, and this causes the electrode to increase its temperature to expand. As a result, the electrode detaches from the resistance heating layer. Furthermore, oxidation of the metal or the like decreases the electrical conductivity of the electrode.

According to the present invention as shown in FIG. 5, the electrode 415 has a double-layered structure in which an electrode surface layer 4152 (second electrode layer) is layered on an electrode interlayer 4151 (first electrode layer). The electrode 415 is provided on a part on each end of the heat fixing belt 41 in the roller shaft direction where the elastic layer 413 and the releasing layer 414 are not formed, such that the electrode interlayer 4151 is layered on the resistance heating layer 412. The electrode interlayer 4151 and the electrode surface layer 4152 are layered on the resistance heating layer 412 by performing plating process. The electrode 415 here has a width (length in the roller shaft direction) of 5-50 [mm] for example.

The electrode interlayer 4151 and the surface layer 4152 are each formed of metal having a low electrical resistivity, and formed along the entire circumference of the heat fixing belt 41. This structure eliminates the potential difference within the electrode 415, and as a result an electric current is carried uniformly through the resistance heating layer 412 between the electrodes 415 provided on the respective ends of the heat fixing belt 41 in the roller shaft direction. Accordingly, it is possible to cause the resistance heating layer 412 to uniformly generate heat.

Since the power feeding member 44 is pressed into sliding contact with the electrode surface layer 4152, the electrode surface layer 4152 is preferably formed of a highly abrasion-resistant metal, namely a highly hard metal. Furthermore, the electrode surface layer 4152 is preferably formed of a highly oxidation-resistant metal. In order to prevent detachment of the electrode interlayer 4151 from the resistance heating layer 412, the electrode interlayer 4151 is preferably formed of metal having a small difference in linear expansion coefficient from the resin such as PI, which is a base material of the resistance heating layer 412. More specifically, it is preferable that the difference in linear expansion coefficient between the metal for the electrode interlayer 4151 and such a resin is smaller than that between the metal for the electrode surface layer 4152 and such a resin. As described above, the electrode 415 has a double-layered structure. The electrode surface layer 4152 contacting the power feeding member 44 is formed of a metal having a high hardness and a high oxidation resistance. The electrode interlayer 4151 contacting the resistance heating layer 412 is formed of a metal having a linear expansion coefficient that is between that of the resistance heating layer 412 and that of the electrode surface layer 4152. With such a structure of the electrode 415, it is possible to achieve the electrode 415 that has a high abrasion-resistance and a high durability and is unlikely to decrease in electrical conductivity due to oxidation and detachment from the resistance heating layer 412.

In other words, according to the present invention, since the electrode has a double-layer structure, it is possible to determine a linear expansion coefficient more flexibly. This results in less detachment of electrode. Also, it is difficult for an electrode formed of a single type of metal to exhibit both of an excellent detachment resistance and an excellent oxidation resistance. However, by using a double-layered electrode, it is possible to more freely select metal materials for the electrode, thereby decreasing the detachment of electrode and maintaining the electrical conductivity. As described above, by structuring an electrode formed of electrode layers each having different function and property, it is possible to exhibit both of an excellent detachment resistance and an excellent oxidation resistance.

FIG. 6 is a table showing electrical resistivity, linear expansion coefficient, Mohs hardness, oxidation resistance, suitability for electrode interlayer, and suitability for electrode surface layer, with respect to metals. In the test on the suitability for electrode surface layer, it is judged that a metal that satisfies the following conditions is suitable, and otherwise is unsuitable: an electrical resistivity of 7 [$10^{-8}$ Ω·m] or less; a Mohs hardness of 4 or greater; and an excellent oxidation resistance. In the test on the suitability for electrode interlayer, it is judged that a metal that satisfies the following conditions is suitable, and otherwise is unsuitable; an electrical resistivity of 7 [$10^{-8}$ Ω·m] or less; and a linear expansion coefficient equal to or higher than that of copper, which exhibited a preferable detachment resistance, namely a linear expansion coefficient of 1.7 [$10^{-5}$/° C.] or higher.

(1-5. Endurance Test of Electrode 415)

In the table shown in FIG. 6, tungsten and nickel were judged to have a preferable suitability for electrode surface layer. Tungsten is a so-called rare metal whose reserve amount is small on the earth and is expensive, and accordingly is inappropriate for general use. Therefore, nickel is more appropriate for the electrode surface layer 4152. In consideration of this, in the endurance test, nickel was used as the electrode surface layer 4152, and copper was used as the electrode interlayer 4151. Copper has excellent general purpose properties and is suitable for plating, and was selected from the metals which have been judged to have preferable a suitability for electrode interlayer.

The endurance test was performed using an electrode 415 as a test piece. The electrode 415 was prepared, as shown in FIG. 2 and FIG. 5, by forming a copper-plated electrode interlayer 4151 having a thickness of 10 [mm] on a resistance heating layer 412 provided on each end of the heat fixing belt 41 in the roller shaft direction, and layering a nickel-plated electrode surface layer 4152 having a thickness of 4 [mm] on the electrode interlayer 4151. The endurance test was performed in the following manner. With respect to each of 10 test pieces, heat test (300° C.×200 hours) was performed, and then measurement or observation was performed for each of oxidation resistance, detachment resistance, and electrical conductivity. In the oxidation resistance test, appearance of the electrode 415 of each of the test pieces on which the heat test has been performed was observed, and it was counted the number of test pieces that have not been blackened by oxidation. In the detachment resistance test, after the heat test was performed, a copper-graphite carbon brush was pressed to a surface of the electrode 415 at a pressure of 400 [g/cm$^2$], and then the test pieces were rotated for five hours. Then, the appearance of the electrode 415 was observed, and it was counted the number of test pieces whose electrode has not detached. In the electrical conductivity test, after the heat test was performed, eight points on a circumferential surface of the electrode 415 are determined in the following way. Based on the assumption that the test piece including the electrode 415 has a circular cross section that is perpendicular to the roller shaft direction, an arbitrary one point along the circle is determined as 0°, and seven other points are selected where the angle becomes 45°, 90°, 135°, 180°, 225°, 270°, and 315°. Then, an electrical resistance was measured, at the eight points, between a front surface of the electrode 415 and a back surface of the resistance heating layer 412 (a surface opposite to the surface of the resistance heating layer 412 on which the electrode 415 is formed). It is counted the number of test pieces having an electrical resistance of 0.1[Ω] or less at all of the eight points.

Note that the electrical conductivity was measured using a heat fixing belt without the insulation layer 411.

Figures 7, 8:
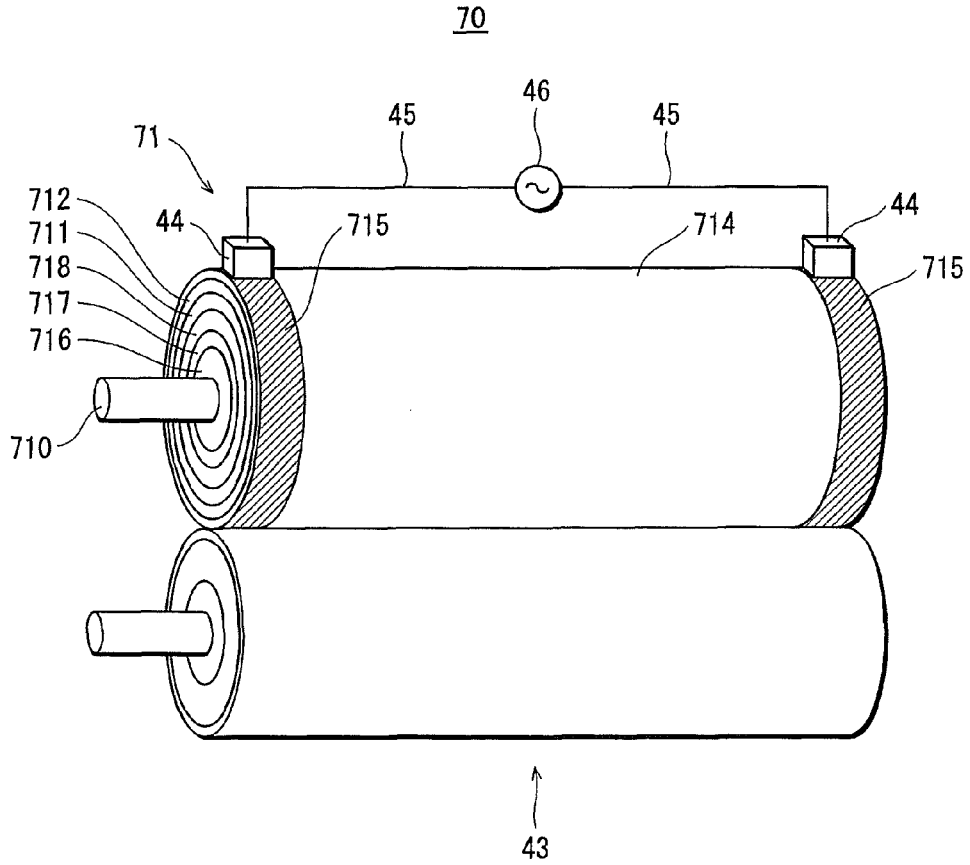
FIG. 7 shows results of endurance test on electrodes.
FIG. 8 is a schematic pattern view showing a principal structure of a fixing device relating to an Embodiment 2 of the present invention.

FIG. 7 shows the results of the endurance test. FIG. 7 also shows a result of the endurance test performed in the same way on an electrode formed of a single layer of copper or nickel for comparison.

With respect to the electrode 415 that has a double-layered structure including the electrode interlayer 4151 formed of copper and the electrode surface layer 4152 formed of nickel, eight out of 10 test pieces showed excellent results in all of the tests of oxidation resistance, detachment resistance, and electrical conductivity.

Compared with this, with respect to the electrode 415 that is formed of a single copper layer, all of 10 test pieces showed oxidation in the test of oxidation resistance, and only two of the 10 test pieces showed a maintained electrical conductivity in the test of electrical conductivity. Also, with respect to the electrode 415 that is formed of a single nickel layer, eight of 10 test pieces showed excellent oxidation resistance in the test of oxidation resistance. However, only three of the 10 test pieces did not show detachment of electrode, and as many as seven test pieces showed detachment of the electrode.

The above results of the endurance test proved that it is possible to achieve an electrode having a high durability by having the following structures: the electrode has a double-layered structure; as the electrode surface layer 4152 that receives an electrical power from the power feeding member 44, a metal is used that has a high hardness and a high oxidation resistance; as the electrode interlayer 4151 that is in contact with the resistance heating layer 412, a metal is used that has a linear expansion coefficient closer to that of the base material of the resistance heating layer 412 than that of the metal material of the electrode surface layer 4152.

Note that since the electrode surface layer 4152 is formed on the electrode interlayer 4151 by performing plating process, side surfaces on both ends (outer sides) of the electrode interlayer 4151 in the roller shaft direction are covered with the electrode surface layer 4152 (see FIG. 5). This prevents oxidation of the electrode interlayer 4151.

Also, the thicknesses of the electrode interlayer 4151 and the electrode surface layer 4152 are not limited to the respective values shown in the above endurance test. The electrode surface layer 4152 may have a thickness of 1-10 [μm] for example, and may more preferably have a thickness of 1-4 [μm]. The electrode interlayer 4151 may have a thickness of 1-10 [μm] for example, and may more preferably have a thickness of 2-5 [μm]. In this case, by setting the thickness of the electrode interlayer 4151 greater than the thickness of the electrode surface layer 4152, the electrode interlayer 4151 can more efficiently absorb the influence of the thermal expansion of the resistance heating layer 412.

As described, the present embodiment has provided the description of the structure where the heat fixing belt 41 includes the double-layered structure electrode 415 composed of the electrode interlayer 4151 and the electrode surface layer 4152. With such a structure, it is possible to realize a fixing device including an electrode having a low electrical resistivity and a high durability, and an image forming apparatus including the fixing device.

Embodiment 2

The above Embodiment 1 has described the structure in which the electrode 415 is included in the heat fixing belt 41.

An Embodiment 2 describes the structure in which the electrode 415 is included in a roller.

In order to avoid duplication of the description, structural elements that are equivalent to their counterparts in the Embodiment 1 are assigned the same referential numerals, and description thereof is omitted here.

FIG. 8 is a schematic view showing the outline structure of a fixing device 70 relating to the Embodiment 2. The fixing device 70 has a structure in which the pressurizing roller 43 is forced by a forcing mechanism (not shown) toward the heating roller 71 as a heating rotary member to form a fixing nip. On the entire outer circumferential surface of each end of the heating roller 71 in the shaft direction, the electrode 715 is provided. The power feeding member 44 is pressed by the elastic member 491 to the electrode 715.

Figure 9:
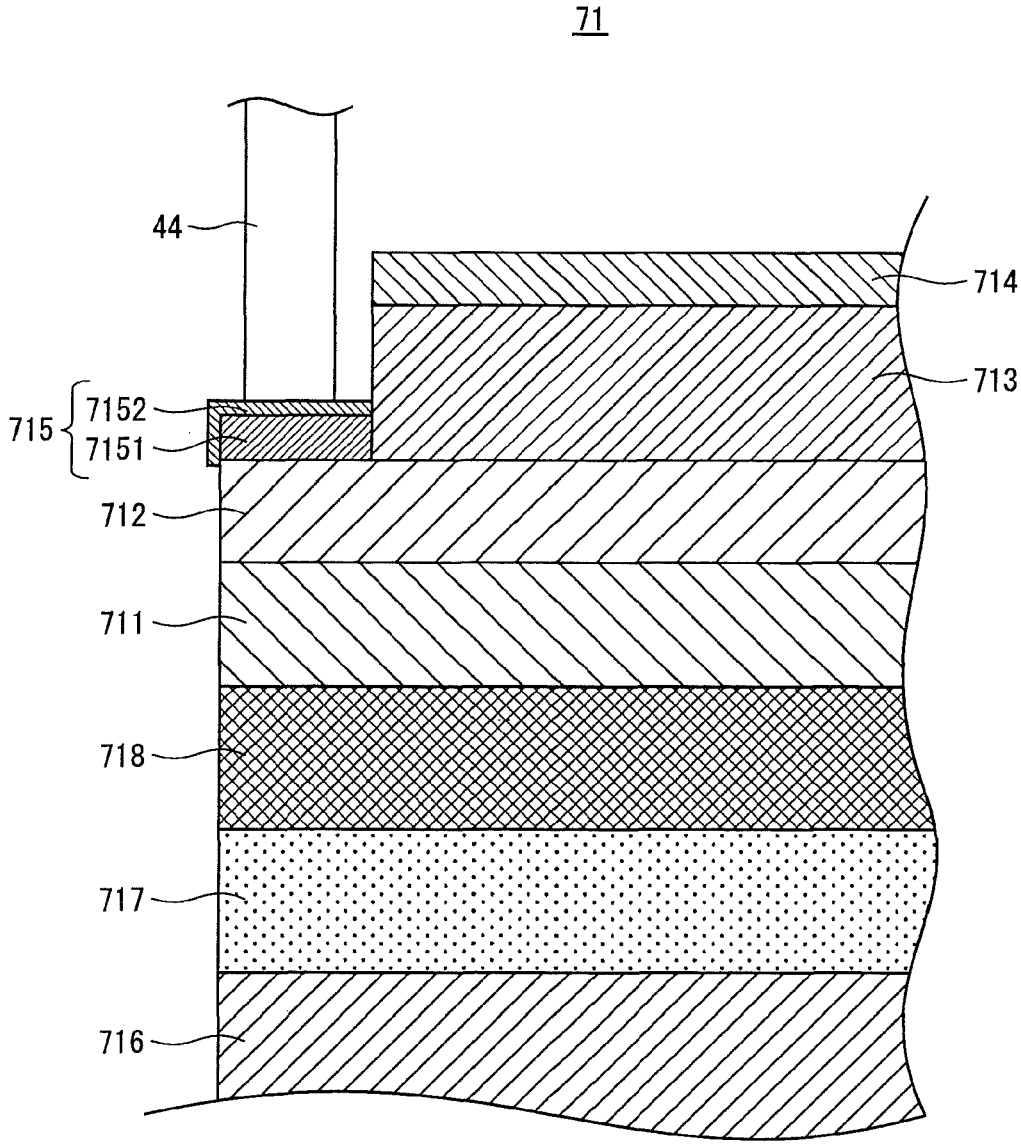
FIG. 9 is a partially enlarged cross-sectional pattern view showing an outline structure of a heating roller and an electrode that are included in the fixing device relating to the Embodiment 2 of the present invention.

FIG. 9 is a partially enlarged cross-sectional pattern view showing the heating roller 71 of the fixing device 70, taken along a planar surface including the roller shaft. The heating roller 71 is formed by layering, on a cylindrical metal core 716, a rubber layer 717, a sponge layer 718, an insulation layer 711, a resistance heating layer 712, an elastic layer 713, and a releasing layer 714 in this order. Although FIG. 9 shows only one end of the heating roller 71, the heating roller 71 has a part on each end in the roller shaft direction where the elastic layer 713 and the releasing layer 714 are not formed. In this part, an electrode 415 is provided on the resistance heating layer 712. In this part of the heating roller 71, an electrode 715 is provided on the resistance heating layer 712. The electrode 715 is formed by layering an electrode surface layer 7152 (second electrode layer) on a electrode interlayer 7151 (first electrode layer) contacting the resistance heating layer 712.

The metal core 716 (shaft) is formed of aluminum, stainless, or the like, and has a diameter of 20-100 [mm] for example. The rubber layer 717 is formed of a heat resistant rubber such as a silicone rubber and a fluorine rubber, and has a thickness of 0-4 [mm] for example. Since the heating roller 71 may not include the rubber layer 717, the above thickness of the rubber layer 717 includes 0 [mm]. The sponge layer 718 is composed of a heat resistant foamed rubber such as a silicone rubber and a fluorine rubber, and has a thickness of 1-5 [mm] for example.

The insulation layer 711, the resistance heating layer 712, the elastic layer 713, the releasing layer 714, the electrode interlayer 7151, and the electrode surface layer 7152 have the same structures as the insulation layer 411, the resistance heating layer 412, the elastic layer 413, the releasing layer 414, the electrode interlayer 4151, and the electrode surface layer 4152 relating to the Embodiment 1, respectively. Accordingly, the descriptions of these structures are omitted here.

As described, the present embodiment has provided the description of the structure where the heating roller 71 includes the double-layered structure electrode 715 composed of two layers of the electrode interlayer 7151 and the electrode surface layer 7152. According to the present embodiment, as well as the Embodiment 1, it is possible to realize a fixing device including an electrode having a low electrical resistivity and a high durability, and an image forming apparatus including the fixing device.

Modification Examples

Although the present invention has been described based on the above embodiments, the present invention is not of course limited to the above embodiments, and the following modification examples may be employed.

Note that, in the following modifications, in order to avoid duplication of the description, structural elements that are equivalent to their counterparts in the Embodiments 1 and 2 are assigned the same referential numerals, and description thereof is omitted here.

(1) In the above Embodiments 1 and 2, the electrode 415 has a double-layered structure. Alternatively, the electrode 415 may have a structure of three or more layers. In such a case, it is preferable that each layer is formed of metal having a low electrical resistivity and an electrode layer contacting the resistance heating layer 412 is formed of metal having a small difference in linear expansion coefficient from the binder resin that is the base material of the resistance heating layer 412. Furthermore, it is preferable that the difference in linear expansion coefficient is small between metals used for each two adjacent layers.

(2) In the above Embodiment 1, the electrode 415 is provided on the entire outer circumferential surface of each end of the heat fixing belt 41 in the roller shaft direction, and in the above Embodiment 2, the electrode 715 is provided on the entire outer circumferential surface of each end of the heating roller 71 in the roller shaft direction. Alternatively, it may be possible to employ a structure where the electrode 415 and the electrode 715 are not continuously formed on the heat fixing belt 41 and the heating roller 71 in the circumferential direction, respectively.

(3) In the above Embodiment 1, the electrodes 415 are provided on the outer circumferential surface of the heat fixing belt 41, and a force is applied to the power feeding member 44 from the outside of the circumferential surface of the heat fixing belt 41 so as to be brought in pressure-contact with the electrodes 415. Alternatively, the electrodes 415 may be provided on the inner circumferential surface of the heat fixing belt 41, and the power feeding member 44 may be arranged inside the heat fixing belt 41 and a force is applied to the power feeding member 44 from the inside of the heat fixing belt 41 so as to be pressure-contacted with the electrodes 415.

(4) In the above Embodiment 1, although the fixing roller 42 is loosely inserted into the inside of the rotation path of the heat fixing belt 41, the structure of the fixing roller 42 is not limited to this.

Alternatively, it may be possible to loosely insert, into the inside of the rotation path of the heat fixing belt 41, a pressure receiving member, which guides the heat fixing belt 41 in the rotational direction without rotating in accordance with the rotation of the heat fixing belt 41, and is pressed by the pressurizing roller 43 via the heat fixing belt 41.

(5) In the above Embodiments 1 and 2, the electrodes 415 and 715 are provided on the outer circumferential surfaces of the heat fixing belt 41 and the heating roller 71, respectively. A force is applied to the power feeding members 44 from the outside of the circumferential surfaces of the heat fixing belt 41 and the heating roller 71 so as to bring the power feeding members 44 into pressure-contact with the electrodes 415 and 715, respectively. Alternatively, the following structure may be employed, for example. The electrodes 415 and 715 may be provided on each of end surfaces, that is, side surfaces of the heat fixing belt 41 in the roller shaft direction and the heating roller 71 in the shaft direction, respectively. The power feeding members 44 may be brought into pressure-contact with the electrodes 415 and 715 in a direction from both ends toward the center of the roller shaft, respectively. In this case, in order to ensure stable power feeding, it may be possible to have a certain amount of width of the electrodes 415 and 715 (length of the electrodes 415 and 715 in the direction from the inside to the outer circumferential surface of the heat fixing belt 41 and the heating roller 71), regardless of the thickness of the resistance heating layers 412 and 712.

(6) In the above Embodiment 1, the heat fixing belt 41 is supported by being sandwiched between the fixing roller 42 and the pressurizing roller 43, and keeps its shape owing to its rigidity. Alternatively, the heat fixing belt 41 may be suspended between a plurality of rollers or the like in a tension state.

(7) The specific numerical values in the above embodiments are just examples, and the present invention is of course not limited these numerical values.

(8) In the above Embodiment 1, the heat fixing belt 41 has a rotation path falling within a predetermined range owing to its rigidity. Alternatively, a control member may be provided in a space 47 inside the rotation path such that the rotation path falls within the predetermined range.

(9) The present invention is not limited to a tandem-type digital color printer, and is applied to any image forming apparatus that generally includes a heat fixing device, such as a black-and-white/color copy machine, a printer, a FAX, and an MFP (Multifunction Peripheral) having functions of such copy machine, printer, and FAX.

The characteristics and effects of the present invention can be summarized as follows.

The fixing device relating to one aspect of the present invention is a fixing device comprising: a heating rotary member that has a resistance heating layer that generates heat when an electrical current is applied; a pressurizing rotary member that is brought into pressure-contact with an outer circumferential surface of the heating rotary member so as to form a fixing nip, through which a recording sheet on which an unfixed toner image has been formed passes for heat fixing; a pair of circular electrodes that are each circumferentially formed at a respective one of two positions on the outer circumferential surface of the heating rotary member, and feed an electrical power to the resistance heating layer, the two positions sandwiching a sheet passing region therebetween, wherein the electrodes are each metallic and formed of at least two electrode layers including a first electrode layer that is layered directly on the resistance heating layer and a second electrode layer that is an outermost layer, difference in linear expansion coefficient between the first electrode layer and the resistance heating layer is smaller than difference in linear expansion coefficient between the second electrode layer and the resistance heating layer, and the second electrode layer is more oxidation-resistant than the first electrode layer.

With the above structure, it is possible to suppress the reduction in electrical conductivity caused by detachment of electrodes from the resistance heating layer and oxidation of electrodes, thereby providing a fixing device including an electrode with a low electrical resistivity and a high durability.

Here, according to the fixing device relating to another aspect of the present invention, the second electrode layer has a higher Mohs hardness than the first electrode layer.

With the above structure, it is possible to suppress the abrasion of the first electrode layer due to sliding contact with the power feeding members for feeding an electrical power to the electrode, thereby providing a fixing device including an electrode having a high durability.

According to the fixing device relating to yet another aspect of the present invention, the heating rotary member is an endless belt that has a pressing member provided inside a rotation path thereof, and the fixing nip is formed between the heating rotary member and the pressurizing rotary member by the pressing member pressing the heating rotary member toward the pressurizing rotary member.

With the above structure, it is possible to provide a fixing device including an electrode having a high durability even in the case where the fixing device employs a heating belt in which a heat generation efficiency is high but an electrode is likely to detach from the resistance heating layer due to deformation of the heating belt caused by heat expansion.

According to the fixing device relating to further yet another aspect of the present invention, the resistance heating layer is obtained by uniformly dispersing conductive fillers in polyimide so as to have a predetermined electrical resistivity, the first electrode layer includes copper, and the second electrode layer is formed of nickel.

With the above structure, it is possible to provide a fixing device including an electrode having a high durability by using a material having excellent general purpose properties.

According to the fixing device relating to further yet another aspect of the present invention, the first electrode layer has a greater thickness than the second electrode layer.

With the above structure, it is possible to cause the first electrode layer to absorb the influence of the thermal expansion of the resistance heating layer to a great extent in order to suppress detachment of the electrode from the resistance heating layer, thereby providing a fixing device including an electrode having a high durability.

According to the fixing device relating to further yet another aspect of the present invention, the two positions are respective ends of the outer circumferential surface of the heating rotary member in a direction of a rotating shaft thereof.

With the above structure, it is possible to maximize a region that generates heat when an electrical current is applied between the electrodes. Therefore, it is also possible to maximize the region through which a recording sheet passes, thereby realizing the size-reduction of the heating rotary member.

According to the fixing device relating to further yet another aspect of the present invention, the heating rotary member has, between the two positions, an outermost releasing layer that is circumferentially formed on an entire circumference thereof.

With the above structure, the recording sheet becomes easily detached from the outer circumferential surface of the heating rotary member after a toner image is thermally fixed onto the recording sheet when the recording sheet passes through the fixing nip. This can reduce the risk of occurrence of a trouble such as a paper jam Also, the present invention can provide an image forming apparatus including the fixing device having the above characteristics. Also in this case, it is possible to obtain the same effects as those described above.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device comprising:

a heating rotary member that has a resistance heating layer that generates heat when an electrical current is applied;

a pressurizing rotary member that is brought into pressure-contact with an outer circumferential surface of the heating rotary member so as to form a fixing nip, through which a recording sheet on which an unfixed toner image has been formed passes for heat fixing;

a pair of circular electrodes that are each circumferentially formed at a respective one of two positions on the outer circumferential surface of the heating rotary member, and feed an electrical power to the resistance heating layer, the two positions sandwiching a sheet passing region therebetween, wherein the electrodes are each metallic and formed of at least two electrode layers including a first electrode layer that is layered directly on the resistance heating layer and a second electrode layer that is an outermost layer, a difference in linear expansion coefficient between the first electrode layer and the resistance heating layer is smaller than a difference in linear expansion coefficient between the second electrode layer and the resistance heating layer, and the second electrode layer is more oxidation-resistant than the first electrode layer.

2. The fixing device of claim 1, wherein the second electrode layer has a higher Mohs hardness than the first electrode layer.

3. The fixing device of claim 1, wherein the heating rotary member is an endless belt that has a pressing member provided inside a rotation path thereof, and the fixing nip is formed between the heating rotary member and the pressurizing rotary member by the pressing member pressing the heating rotary member toward the pressurizing rotary member.

4. The fixing device of claim 1, wherein the resistance heating layer is obtained by uniformly dispersing conductive fillers in polyimide so as to have a predetermined electrical resistivity, the first electrode layer includes copper, and the second electrode layer is formed of nickel.

5. The fixing device of claim 1, wherein the first electrode layer has a greater thickness than the second electrode layer.

6. The fixing device of claim 1, wherein the two positions are respective ends of the outer circumferential surface of the heating rotary member in a direction of a rotating shaft thereof.

7. The fixing device of claim 1, wherein the heating rotary member has, between the two positions, an outermost releasing layer that is circumferentially formed on an entire circumference thereof.

8. The fixing device of claim 1, wherein the first electrode layer of at least one of the electrodes directly contacts the second electrode layer of the at least one electrode.

9. An image forming apparatus comprising:

an image forming part operable to form an unfixed toner image on a recording sheet; and a fixing device operable to thermally fix the unfixed toner image onto the recording sheet, the fixing device including:

a heating rotary member that has a resistance heating layer that generates heat when an electrical current is applied;

a pressurizing rotary member that is brought into pressure-contact with an outer circumferential surface of the heating rotary member so as to form a fixing nip, through which a recording sheet on which an unfixed toner image has been formed passes for heat fixing;

a pair of circular electrodes that are each circumferentially formed at a respective one of two positions on the outer circumferential surface of the heating rotary member, and feed an electrical power to the resistance heating layer, the two positions sandwiching a sheet passing region therebetween, wherein the electrodes are each metallic and formed of at least two electrode layers including a first electrode layer that is layered directly on the resistance heating layer and a second electrode layer that is an outermost layer, a difference in linear expansion coefficient between the first electrode layer and the resistance heating layer is smaller than a difference in linear expansion coefficient between the second electrode layer and the resistance heating layer, and the second electrode layer is more oxidation-resistant than the first electrode layer.

10. The image forming apparatus of claim 9, wherein the second electrode layer has a higher Mohs hardness than the first electrode layer.

11. The image forming apparatus of claim 9, wherein the heating rotary member is an endless belt that has a pressing member provided inside a rotation path thereof, and the fixing nip is formed between the heating rotary member and the pressurizing rotary member by the pressing member pressing the heating rotary member toward the pressurizing rotary member.

12. The image forming apparatus of claim 9, wherein the resistance heating layer is obtained by uniformly dispersing conductive fillers in polyimide so as to have a predetermined electrical resistivity, the first electrode layer includes copper, and the second electrode layer is formed of nickel.

13. The image forming apparatus of claim 9, wherein the first electrode layer has a greater thickness than the second electrode layer.

14. The image forming apparatus of claim 9, wherein the first electrode layer of at least one of the electrodes directly contacts the second electrode layer of the at least one electrode.

* * * * *